United States Patent [19]

Sullivan et al.

[11] Patent Number: 4,964,796

[45] Date of Patent: Oct. 23, 1990

[54] SWAG CENTERPIECE WITH TAPER CANDLE/CHIMNEY GLASS INSERT

[75] Inventors: Marian D. Sullivan; Elaine A. Deelstra, both of Sioux Falls, S. Dak.

[73] Assignee: Sullivan, Inc., Sioux Falls, S. Dak.

[21] Appl. No.: 468,904

[22] Filed: Jan. 23, 1990

Related U.S. Application Data

[63] Continuation-in-part of Ser. No. 327,338, Mar. 22, 1989, Pat. No. 4,895,512, which is a continuation-in-part of Ser. No. 102,037, Sep. 29, 1987, Pat. No. 4,815,967.

[51] Int. Cl.[5] ..... F23D 3/00

[52] U.S. Cl. ..... 431/289; 431/297; 362/163; D26/10; D11/143; D11/144; 248/27.8

[58] Field of Search ..... 431/295, 296, 297, 289; 362/163; D26/10; D11/143, 144; 248/27.8

[56] References Cited

U.S. PATENT DOCUMENTS

| | | | |
|---|---|---|---|
| D. 202,209 | 9/1965 | Myers et al. | D26/10 |
| 227,088 | 4/1880 | Young | 431/295 |
| 1,602,296 | 10/1926 | Zimmerman | 431/295 |

*Primary Examiner*—Carroll B. Dority

*Attorney, Agent, or Firm*—John W. Bunch

[57] ABSTRACT

An adapter (70) for supporting a taper candle and chimney glass on a candle ring (16) in a centerpiece arrangement includes a plate (72), a candle holder (76), end clip (74) for snap-releasable engagement with the inner ring of the candle ring, and a chimney glass holder (80). The candle ring (16) preferably includes radial extensions or runners (90) in order to form a swag centerpiece.

13 Claims, 5 Drawing Sheets

SWAG CENTERPIECE WITH TAPER CANDLE/CHIMNEY GLASS INSERT

CROSS-REFERENCE TO RELATED APPLICATION

This is a continuation-in-part of co-pending application Ser. No. 07/327,338 filed Mar. 22, 1988, now U.S. Pat. No. 4,895,512, which is a continuation-in-part of co-pending application Ser. No. 07/102,037 filed Sept. 29, 1987, now U.S. Pat. No. 4,815,967.

TECHNICAL FIELD

The present invention relates generally to a mount, and more particularly to a mounting device or adapter for use with a candle ring in a centerpiece arrangement so that a taper candle and chimney glass can be used for more versatility, variety and economy.

BACKGROUND ART

Artificial centerpiece arrangements are typically used on tables and the like for decorative purposes. Such centerpiece arrangements often include a candle and surrounding candle ring on which artificial flowers, leaves and the like are attached. The candle rings have been available for years and generally consist of one plastic ring member, or several tiered ring members of different diameters, each having mounted pegs thereon to which the artificial flowers, leaves and the like are attached.

In order to vary the appearance of such centerpiece arrangements to fit the occasion, the candle or flowers can be changed. Changing the artificial flowers on the candle ring can be both expensive and time consuming. Heretofore, candle rings traditionally have been adapted for use with column or pillar candles, which are relatively bulky and expensive and tend to be less readily available and/or only available in limited colors and styles. Because these candle rings have been previously limited to a single size candle, the kinds of centerpiece arrangements possible have not been as varied or versatile as they might have been.

Some centerpiece arrangements would be much more attractive with the relatively taller, less expensive and more readily available taper candles, but there has not been available heretofore an adapter by which such candles could be used with candle rings in a way that enables the user to utilize either pillar or taper candles as desired with a particular candle ring for maximum variety and versatility.

Nor has there been available heretofore an adapter by which a taper candle and chimney glass could be utilized as desired with a particular candle ring for even more variety and versatility.

A need has thus arisen for a taper candle bar which can be inserted into an existing candle ring enabling the use of taper candle and chimney glass and when removed, reverting the candle ring back for use with original pillar candle, while still maintaining the original centerpiece style design.

SUMMARY OF INVENTION

The present invention comprises an adapter bar that overcomes the foregoing and other difficulties associated with the prior art. In accordance with the invention, there is provided a taper candle bar which is adapted for use with a candle ring so that either a pillar candle or one or more taper candles can be utilized as desired without changing candle rings.

The taper candle bar or the first embodiment comprises as elongate base plate of sufficient length to span the inside top diameter of the candle ring. One or two taper holders are mounted in spaced-apart, symmetrical relationship on the plate. Each taper holder preferably includes wedges or gussets therein for securing the candle in place. Clips are provided at opposite ends of the plate for releasable engagement with the candle ring. Each clip is preferably notched to receive a radial piece in the candle ring to achieve a "buckle" effect for balance and stability.

A second embodiment, which is adapted for use with smaller candle rings, includes a single candle holder and a circular base plate that receives the candle ring thereover and rests on the underlying surface for stability. Clips are provided about the candle holder for releasable engagement with the candle ring and to secure the candle ring itself.

A third embodiment includes a single candle holder, a base plate with opposite clips for releasable engagement with the underlying candle ring, and a circumferential arrangement of tange about the candle holder for receiving a chimney glass.

If desired, the candle ring can be modified to include radial extensions or runners with prongs thereon to receive additional artificial flowers, leaves and the like for more versatility in a swag centerpiece arrangement.

BRIEF DESCRIPTION OF DRAWINGS

A better understanding of the invention can be had by reference to the following detailed Description in conjunction with the accompanying Drawings, wherein.

DETAILED DESCRIPTION

Figure 1:
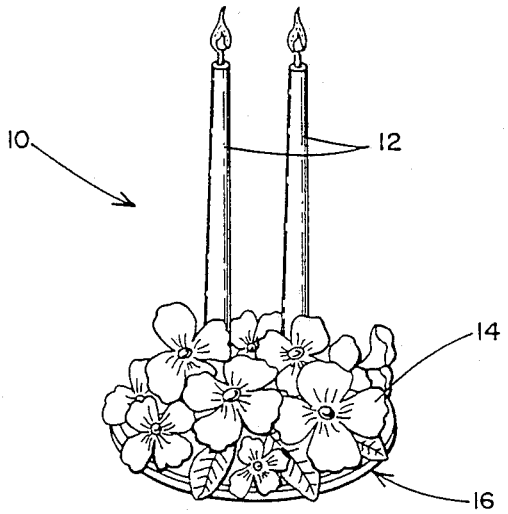
FIG. 1 is a perspective view of a centerpiece arrangement including the taper candle bar of the invention.
Figure 2:
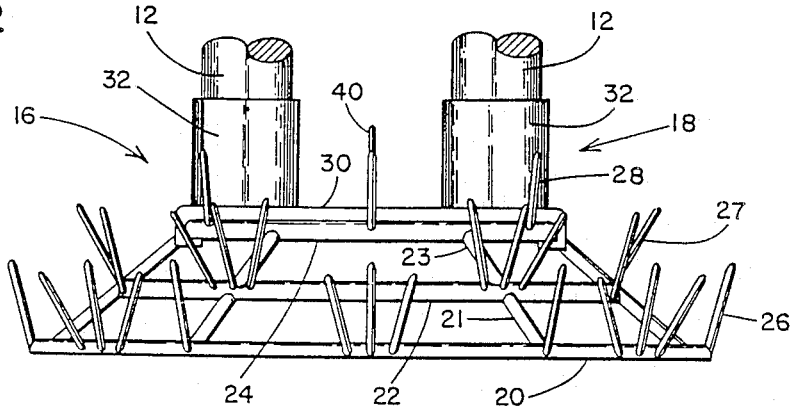
FIG. 2 is a side view of a candle ring with the taper candle bar of the first embodiment.

Referring now to the Drawings, wherein like reference numerals designate like or corresponding parts throughout the views, and particularly referring to FIGS. 1–5, there is shown a centerpiece arrangement 10 incorporating the taper candle bar of the invention. The centerpiece arrangement 10 includes a pair of taper candles 12 and artificial flowers 14. The flowers 14 are mounted on a candle ring 16, and the candles 12 are supported by the taper candle bar 18 of the first embodiment of the invention which is attached to the top of the candle ring, as will be explained more fully hereinafter.

The candle ring 16 is of substantially conventional, tiered construction. The candle ring 16, which is typically of molded plastic, includes three generally concentric ring members 20, 22 and 24 interconnected by generally radial spokes. Ring members 20 and 22 are interconnected by circumferentially spaced-apart spokes 21, and ring members 22 and 24 are similarly interconnected by spokes 23. Prongs 26, 27 and 28 are provided on ring members 20, 22 and 24 respectively, for attachment of the artificial flowers 14, leaves and the like thereto. The candle ring 16 is adapted for placement over a pillar candle (not shown) which extends upwardly through the uppermost, inner ring member 24, which is typically about 3.0 inches in diameter.

Figure 11:
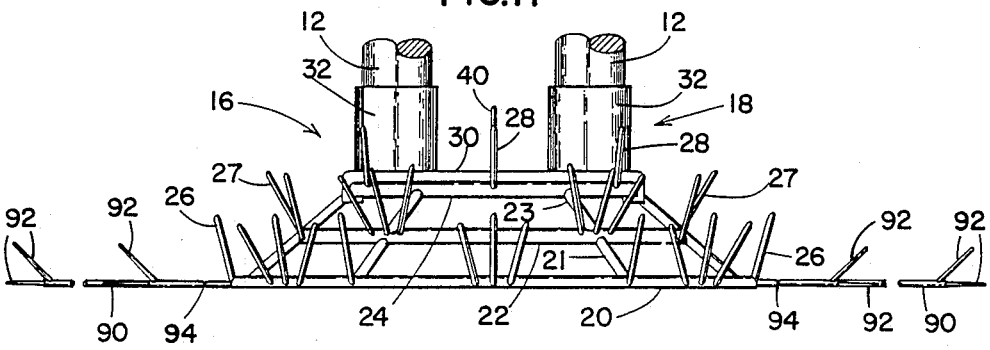
FIG. 11 is a side view of a modified candle ring with the taper candle bar of the first embodiment.
Figure 13:
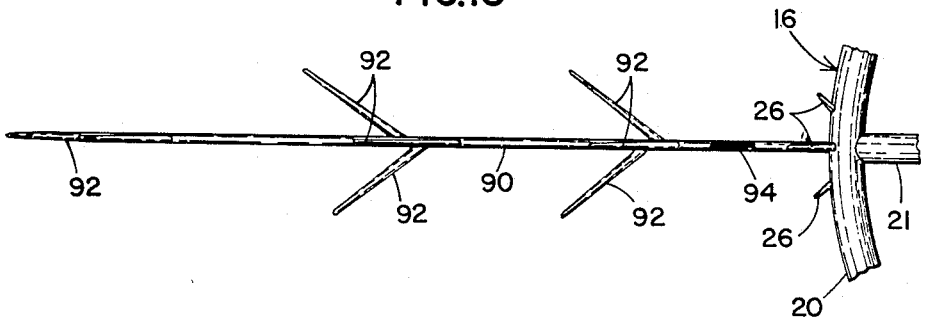
FIG. 13 is a partial top view thereof.

If desired, the candle ring 16 can be modified to include radial extensions or runners 90 in order to form a swag centerpiece. See FIG. 11. In the preferred embodiment as illustrated, two radial runners 90 extend outwardly from the lower most ring member 20 from opposite sides of the candle ring 16. If desired, however, one or suitable number of runners 90 may be used. Prongs 92 are provided on the runners for attachment of additional artificial flowers, leaves and the like (not shown) thereto. Two groups of three prongs 92 are provided along each runner 90, with one group of two prongs being provided at the outer end of the runner as best seen in FIG. 13. The runners 90 and prongs 92 thereon may be molded from plastic integral with the candle ring 16; however, in the preferred embodiment, each runner 90 is molded around a metal wire 94 for reinforcement. The reinforcing wires 94 preferably extend substantially the entire length of runners 90.

Figure 5:
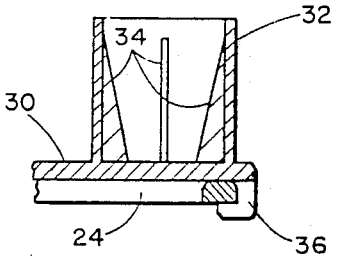
FIG. 5 is an enlarged partial section view taken along lines 5—5 of FIG. 3 in the direction of the arrows.
Figure 3:
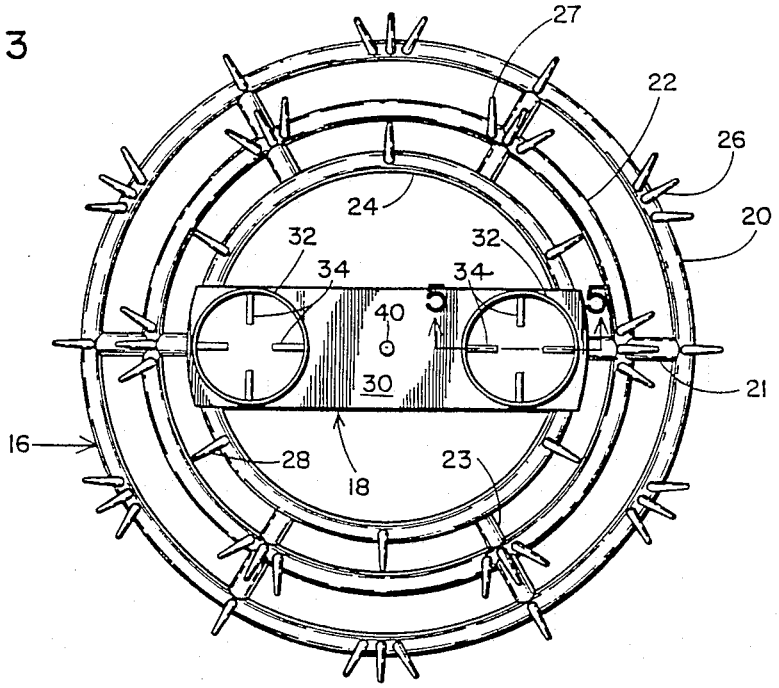
FIG. 3 is a top view thereof.
Figure 4:
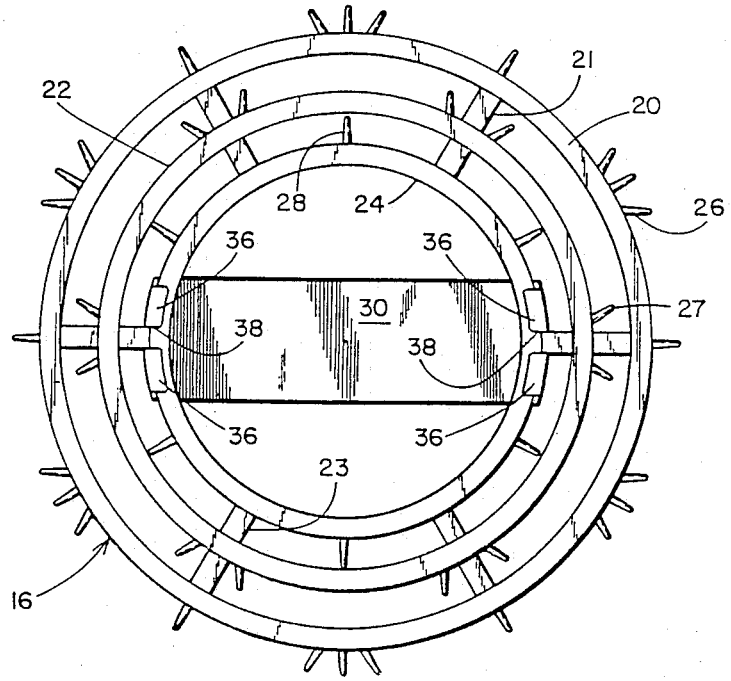
FIG. 4 is a partial bottom view thereof.

If one or two taper candles instead of a pillar candle are desired, the taper candle bar 18 can be used with candle ring 16. The candle taper bar 18 includes a plate 30 which is adapted to span the inner ring 24 of the candle ring 16. A pair of candle holders 32 are provided on plate 30 in spaced-apart, symmetrical relationship with respect to the midpoint of the plate for stability. Each holder 32 preferably includes wedge-shaped gussets 34 therein as best seen in FIGS. 3 and 5, to help secure the taper candles 12 in place. The candle bar 18 is preferably constructed from molded plastic. Although the candle bar 18 includes two symmetrically positioned candle holders 32, a single central holder could be used instead.

Clips 36 are provided at opposite ends of the plate 30 of the taper candle bar 18 for engagement with the candle ring 16. In particular, the clips 36 are adapted to snap over the inner ring member 24. In the preferred embodiment, each clip 36 includes a central notch 38 therein for receiving spokes 23 in the candle ring 16 to provide a "buckle" effect for added stability. Since the spokes 23 in candle ring 16 are arranged in opposite, diametric pairs, this also helps assure proper centering and balance of the taper candle bar 18 on candle ring 16. For purposes of clarity, the candles 12 have been omitted from FIGS. 3 and 5.

If desired, a prong 40 can also be provided on plate 30 midway between holders 32 for attachment of an artificial flower 14 directly to the taper candle bar 18.

Figure 6:
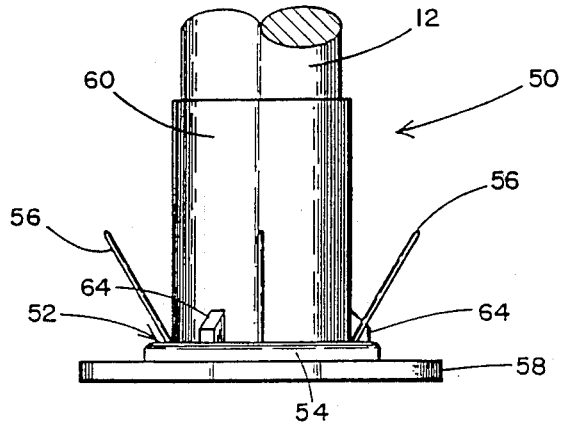
FIG. 6 is a side view of a taper candle bar of the second embodiment.
Figure 7:
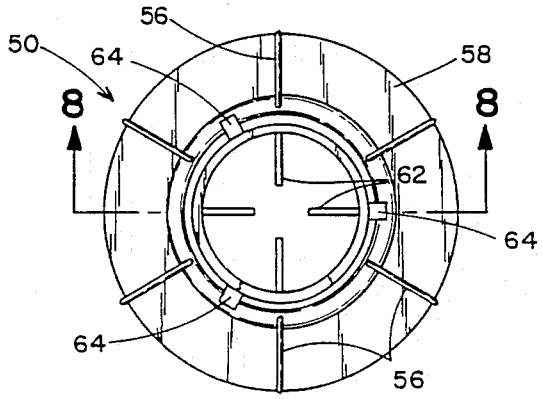
FIG. 7 is a top view thereof.
Figure 8:
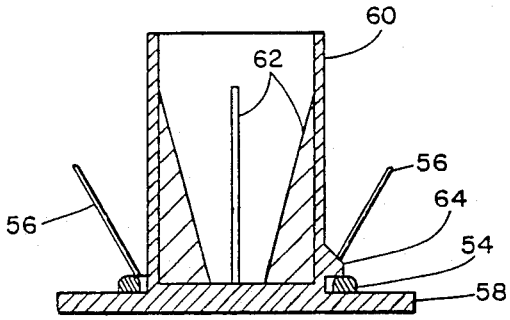
FIG. 8 is and enlarged partial section view taken along lines 8—8 of FIG. 7 in the direction of the arrows.

Referring now to FIGS. 6–8 there is shown a taper candle bar 50 incorporating a second embodiment of the invention. The taper candle bar 50 is particularly adapted for use with a relatively smaller candle ring 52, such as a 1.5 inch candle ring, comprising a single ring member 54 with prongs 56 thereon for receiving artificial flowers, leaves and the like in a centerpiece arrangement which has been omitted for clarity.

The taper candle bar 50 includes a base plate 58 which is circular, instead of elongate, and which is adapted to fit within the ring member 54 of the candle ring 52. In addition, the base plate 58 is of sufficient depth in order to extend through the candle ring 52 and rest directly on the underlying surface. The base plate 52 is preferably enlarged for additional stability. A generally cylindrical candle holder 60 is centrally secured to the base plate 58. Opposing pairs of wedge-shaped gussets 62 are provided therein for engagement with the base end of a single taper candle 12. For purposes of clarity, the candle 12 has been omitted from FIGS. 7 and 8.

The taper candle bar 50 also includes three clips 64 located at even circumferentially spaced-apart positions about the candle holder 60. The clips 64 are angled downwardly and outwardly to engage the ring 54 of the candle ring 52, which snaps down over the candle bar 50, between the clips and onto the base plate 58, in order to provide further stabilization for the taper candle bar 50. The outside diameter of the candle holder 60 is preferably slightly smaller than the inside diameter of ring member 54 to allow for deformation of the ring during connection or disconnection.

Figure 9:
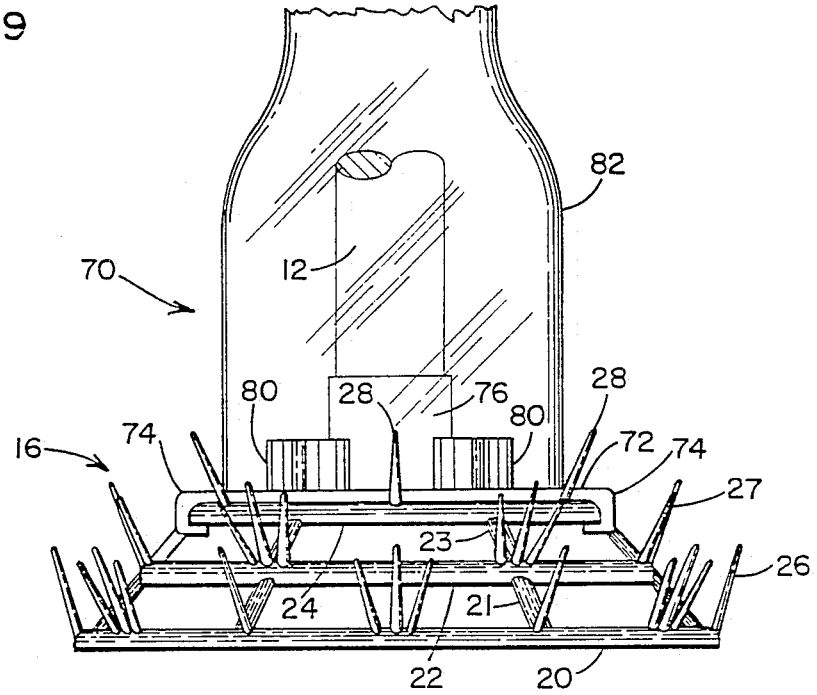
FIG. 9 is a side view of a candle ring with the taper candle/chimney glass bar of the third embodiment.
Figure 10:
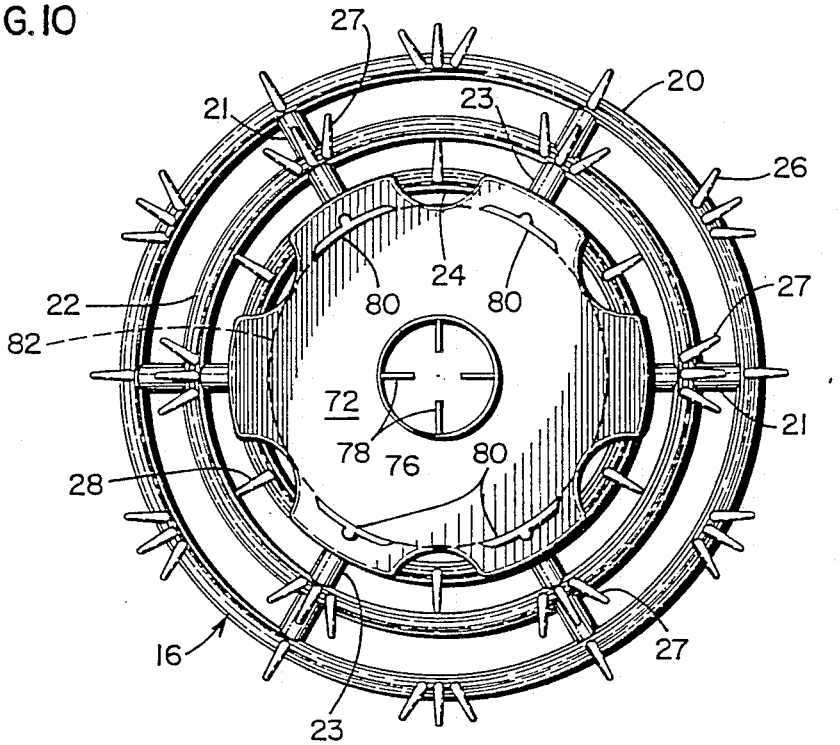
FIG. 10 is a top view thereof.

Referring now to FIGS. 9 and 10 there is shown a taper candle/chimney glass bar 70 incorporating a third embodiment of the invention. The bar 70, which is particularly adapted for use with a tiered candle ring like ring 16 shown herein, includes a base plate 72 of generally circular configuration. The periphery of the base plate 72 is scalloped as shown for clearance with the prongs 28 on the top ring member 24 of candle ring 16. A pair of clips 74 are provided at opposite ends of plate 72 for snap-releasable engagement with the inner ring member 24. Clips 74 are similar in construction and function to clips 36 of the candle bar 18 herein. A generally cylindrical candle holder 76 is centrally secured to base plate 72. Opposing pairs of wedge-shaped gussets 78 are provided therein for engagement with the base end of a single taper candle 12. In addition, a plurality of curved tangs 80 are provided in circumferential arrangement about the candle holder 76 for receiving a chimney glass 82 thereon. As illustrated, four such tangs 80 are utilized, however, any suitable number can be used. The taper candle/chimney glass bar 70 is preferably of integral molded plastic construction.

Figure 12:
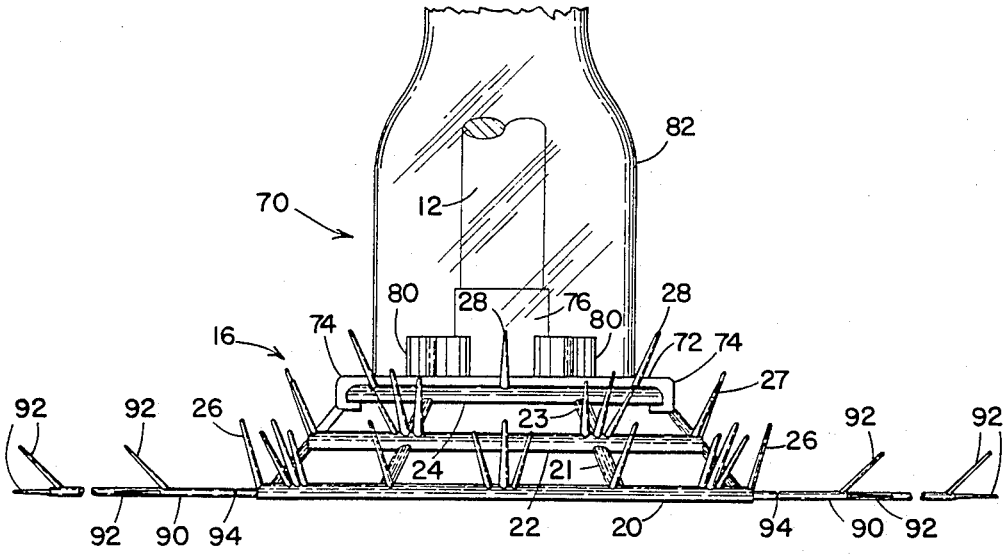
FIG. 12 is a side view (partially cutaway) of a modified candle ring with the taper candle/chimney glass bar of the third embodiment.

FIG. 12 shows the taper candle/chimney glass bar 70 mounted on a modified candle ring 16 incorporating runners 90 in order to form a swag centerpiece.

From the foregoing, it will thus be apparent that the present invention comprises a taper candle bar having numerous advantages over the prior art. One primary advantage is improved versatility so that either column or taper candles can be used with the same candle ring, and without changing the candle ring or the floral arrangement thereon, which in turn increase versatility of the overall centerpiece arrangement. If desired, a chimney glass can also be used. If desired, the candle ring can also be modified to include runners in order to form a swag centerpiece for even more versatility. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangement of elements falling within the scope of the invention as defined by the following claims.

What is claimed is:

1. In a candle ring of the type including a plurality of tiered concentric ring members interconnected by spokes, the improvement comprising:

at least one runner extending radially outward from one of the ring members; and a plurality of prongs on each of said runners for mounting decorations thereon in order to form a swag centerpiece.

2. The candle ring of claim 1, wherein said ring members, spokes, runners and prongs are integrally molded from plastic.

3. The candle ring according to claim 2, further including:

a reinforcing wire molded within each of said runners.

4. The candle ring of claim 1, wherein said prongs are arranged in a plurality of groups along each of said runners, each group including one outwardly projecting prong and a pair of laterally projecting prongs, all of which prongs are angled away from the candle ring.

5. A centerpiece arrangement, comprising a candle ring;

said candle ring including inner and outer tiered, concentric ring members interconnected by spokes;

the inner ring member of said candle ring being dimensioned to receive a pillar candle therethrough;

means for selectively attaching decorations to said candle ring;

at least one runner extending radially outward from the outer ring member of said candle ring;

means for selectively attaching decorations to said runner; and means for releasably mounting a taper candle on the inner ring member of said candle ring.

6. The centerpiece arrangement of claim 5, wherein said candle ring members, spokes and runner are integrally molded from plastic.

7. The centerpiece arrangement according to claim 6, further including a reinforcing wire molded within at least said runner.

8. The centerpiece arrangement of claim 5, wherein said means for selectively attaching decorations to said candle ring comprises groups of outwardly projecting prongs about the inner and outer ring members.

9. The centerpiece arrangement of claim 5, wherein said means for selectively attaching decorations to said runner comprises groups of outwardly projecting prongs provided along said runner.

10. The centerpiece arrangement of claim 5, wherein said means for releasably mounting a candle on said candle ring comprises:

a generally flat plate spanning the inner ring member of said candle ring;

at least one generally cylindrical candle holder mounted in symmetrical position on said plate; and a pair of fixed, spaced-apart clips associated with said plate for snap-releasable engagement with said candle ring;

said plate, candle holder, and clips being integrally molded from plastic.

11. The centerpiece arrangement according to claim 10, further including:

opposite pairs of wedge-shaped internal gussets within said candle holder for engaging a taper candle at its lower end.

12. The centerpiece arrangement according to claim 10, wherein said clips include central notches therein for receipt by the spokes of said candle ring.

13. The centerpiece arrangement according to claim 10, wherein said plate is substantially flat and circular, overlying the inner ring member, and further including:

a chimney-glass holder mounted on said plate in generally concentric surrounding relationship with said candle holder.

* * * * *